US009316191B2

(12) United States Patent
Grandi

(10) Patent No.: US 9,316,191 B2
(45) Date of Patent: Apr. 19, 2016

(54) VALVE ASSEMBLY FOR AN INJECTION VALVE AND INJECTION VALVE

(75) Inventor: Mauro Grandi, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 646 days.

(21) Appl. No.: 13/515,105

(22) PCT Filed: Nov. 18, 2010

(86) PCT No.: PCT/EP2010/067723

§ 371 (c)(1),
(2), (4) Date: Aug. 30, 2012

(87) PCT Pub. No.: WO2011/069793

PCT Pub. Date: Jun. 16, 2011

(65) Prior Publication Data

US 2012/0312903 A1 Dec. 13, 2012

(30) Foreign Application Priority Data

Dec. 11, 2009 (EP) ..... 09015392

(51) Int. Cl.
*B05B 1/30* (2006.01)
*F02M 51/06* (2006.01)

(52) U.S. Cl.
CPC ..... *F02M 51/0685* (2013.01); *F02M 2200/306* (2013.01)

(58) Field of Classification Search
USPC ..... 239/585.5
See application file for complete search history.

(56) References Cited

U.S. PATENT DOCUMENTS

| | | | | |
|---|---|---|---|---|
| 5,131,599 | A * | 7/1992 | Maier | 239/585.4 |
| 6,199,767 | B1 * | 3/2001 | Male et al. | 239/5 |
| 6,279,873 | B1 | 8/2001 | Eichendorf et al. | 251/129.19 |
| 6,510,841 | B1 | 1/2003 | Stier | 123/472 |
| 6,783,086 | B1 * | 8/2004 | Boecking | 239/585.1 |
| 6,808,133 | B1 * | 10/2004 | Stier | 239/585.1 |
| 6,857,584 | B2 | 2/2005 | Sebastian et al. | 239/533.2 |

(Continued)

FOREIGN PATENT DOCUMENTS

| | | | | |
|---|---|---|---|---|
| DE | 19816315 | A1 | 10/1999 | F02M 51/08 |
| DE | 102004056424 | A1 | 5/2006 | F02M 51/06 |
| EP | 1845254 | A1 | 10/2007 | F02M 51/06 |

(Continued)

OTHER PUBLICATIONS

European Search Report, EP Patent Application No. 09015392.5, 5 pages, Feb. 19, 2010

International PCT Search Report and Written Opinion, PCT/EP2010/067723, 9 pages, Jan. 19, 2011.

*Primary Examiner* — Len Tran
*Assistant Examiner* — Adam J Rogers
(74) *Attorney, Agent, or Firm* — Slayden Grubert Beard PLLC

(57) ABSTRACT

A valve assembly for an injection valve may comprise a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle comprising a ring element extending radially and arranged at an axial end of the valve needle facing away from the fluid outlet portion, and an electro-magnetic actuator unit being designed to actuate the valve needle.

13 Claims, 2 Drawing Sheets

(56) References Cited

U.S. PATENT DOCUMENTS

| | | | | |
|---|---|---|---|---|
| 6,932,283 | B2 | 8/2005 | Stier | 239/585.1 |
| 2008/0290194 | A1 * | 11/2008 | Mancini et al. | 239/533.9 |

FOREIGN PATENT DOCUMENTS

| | | | | |
|---|---|---|---|---|
| WO | 02/12712 | A1 | 2/2002 | F02M 51/06 |
| WO | 02/068810 | A1 | 9/2002 | F02M 51/06 |

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2010/067723 filed Nov. 18, 2010, which designates the United States of America, and claims priority to EP Application No. 09015392.5 filed Dec. 11, 2009, the contents of which are hereby incorporated by reference in their entirety.

TECHNICAL FIELD

The disclosure relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

SUMMARY

In one embodiment, a valve assembly for an injection valve comprises: a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle comprising a ring element extending in radial direction and being arranged at an axial end of the valve needle facing away from the fluid outlet portion, and an electro-magnetic actuator unit being designed to actuate the valve needle, the electro-magnetic actuator unit comprising an armature axially movable in the cavity, the armature comprising a recess taking up the ring element and the armature comprising a protrusion extending into the recess in radial direction, wherein a spring element is arranged in the recess axially between the ring element and the protrusion of the armature.

In a further embodiment, the spring element is a coil spring. In a further embodiment, an armature support spring is arranged in the cavity axially between a step of the valve body and the armature. In a further embodiment, the armature support spring is a coil spring.

In another embodiment, an injection valve comprises a valve assembly having any combination of features disclosed above.

BRIEF DESCRIPTION OF THE DRAWINGS

Example embodiments will be explained in more detail below with reference to figures, in which.

DETAILED DESCRIPTION

Figure 1:
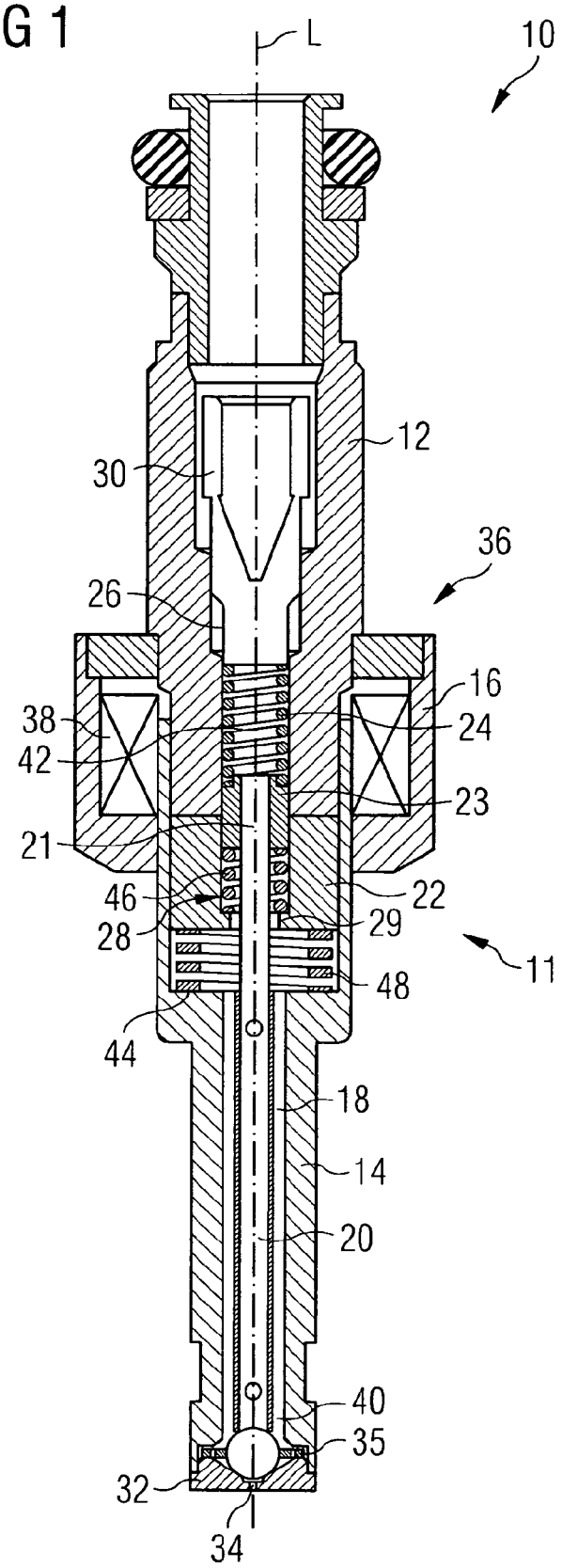
FIG. 1 shows an injection valve with a valve assembly in a longitudinal section view, according to an example embodiment.
Figure 2:
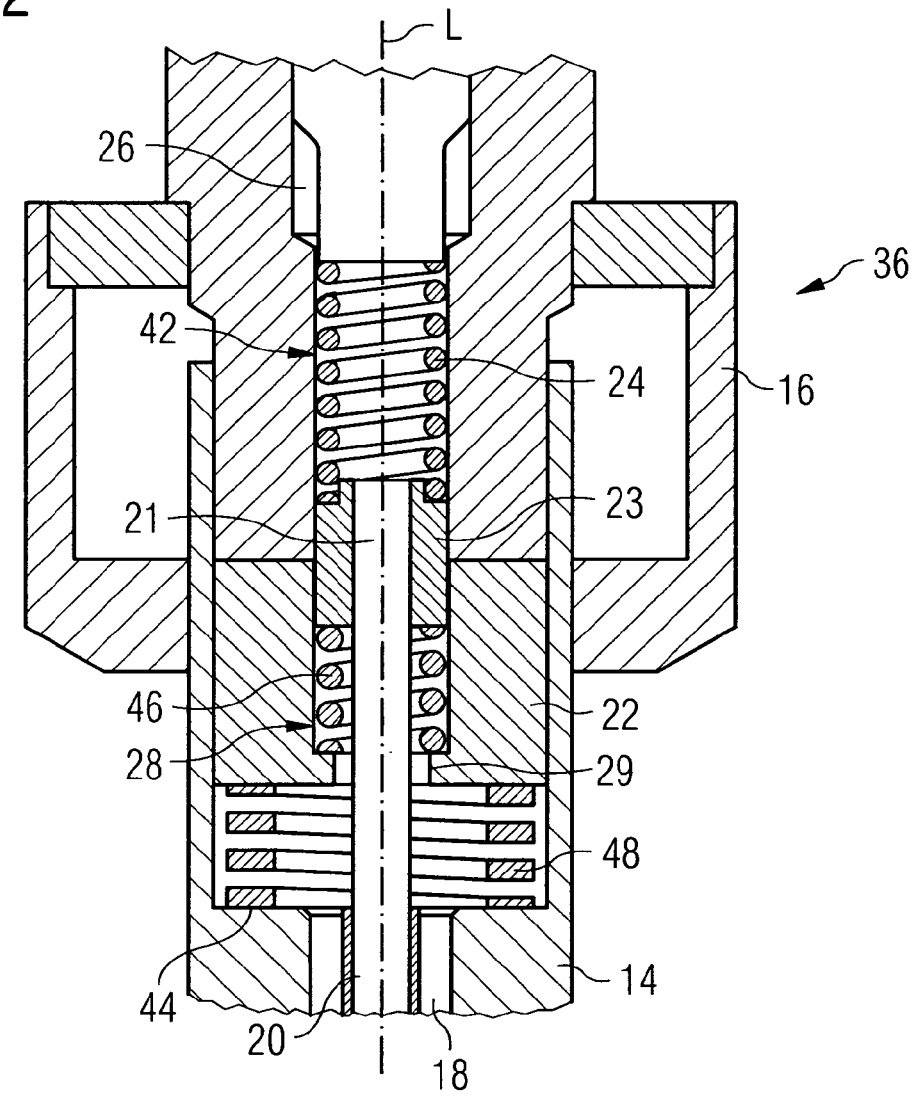
FIG. 2 shows an enlarged view of a section of an electro-magnetic actuator unit of the valve assembly of FIG. 1, according to an example embodiment.

A valve assembly which facilitates a reliable and precise function is provided.

In some embodiments, a valve assembly for an injection valve comprises a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, the valve needle comprising a ring element extending in radial direction and being arranged at an axial end of the valve needle facing away from the fluid outlet portion, and an electro-magnetic actuator unit being designed to actuate the valve needle. The electro-magnetic actuator unit comprises an armature axially movable in the cavity. The armature comprises a recess taking up the ring element. The armature comprises a protrusion extending into the recess in radial direction. A spring element is arranged in the recess axially between the ring element and the protrusion of the armature.

The spring element may be designed to partially decouple the valve needle from the armature.

Thus, the armature acts on the valve needle via the spring element so that the movement of the valve needle may be slightly delayed relative to the armature, which may be advantageous. For example, by this the dynamic behavior of the valve needle is dampened compared to the dynamic behavior of a valve needle which is directly coupled to the armature. Consequently, wearing effects on the valve needle and/or on the armature in the contact area between the valve needle and/or the armature may be kept small. Consequently, a good long term contact between the valve needle and the armature may be obtained and a static flow drift caused by the wearing effects may be kept small. Furthermore, in the long term a reliable transmission of the energy from the armature to the valve needle may be obtained.

In one embodiment the spring element is a coil spring, which may provide a simple shape and a low cost solution. Furthermore, a secure arrangement of the spring element in the recess of the armature may be obtained.

In a further embodiment an armature support spring is arranged in the cavity axially between a step of the valve body and the armature. Thus, the armature may be supported with respect to the valve needle.

In a further embodiment the armature support spring is a coil spring, which may provide a simple shape and a low cost solution. Furthermore, a secure arrangement of the armature support spring in the cavity of the valve body may be obtained.

An injection valve 10 that is in particular suitable for dosing fuel to an internal combustion engine comprises in particular a valve assembly 11 and an inlet tube 12.

The valve assembly 11 comprises a valve body 14 with a central longitudinal axis L. The valve assembly 11 has a housing 16 which is partially arranged around the valve body 14. A cavity 18 is arranged in the valve body 14.

The cavity 18 takes in a valve needle 20 and an armature 22. The valve needle 20 is axially movable in the cavity 18. At an axial end 21 of the valve needle 20 the valve needle comprises a ring element 23. The ring element 23 is formed as a collar around the axial end 21 of the valve needle 20. The ring element 23 is fixedly coupled to the axial end 21 of the valve needle 20. The armature 22 is axially movable in the cavity 18.

A calibration spring 24 is arranged in a recess 26 which is provided in the inlet tube 12. The calibration spring 24 is mechanically coupled to the ring element 23. The ring element 23 forms a first seat for the calibration spring 24

The armature 22 has a recess 28. The valve needle 20 with the ring element 23 is in contact with an inner surface of the armature 22 and can guide the valve needle 20 in axial direction in the recess 28 of the armature 22.

The armature 22 has a protrusion 29 which extends in radial direction into the recess 28. The protrusion 29 may be shaped as a ring element. The protrusion 29 overlaps with the ring element 23 in axial direction.

A filter element 30 is arranged in the inlet tube 12 and forms a further seat for the calibration spring 24. During the manufacturing process of the injection valve 10 the filter element 30 can be axially moved into the inlet tube 12 in order to preload the calibration spring 24 in a desired manner. By this the calibration spring 24 exerts a force on the valve needle 20 towards an injection nozzle 34 of the injection valve 10.

In a closing position of the valve needle 20 it sealingly rests on a seat plate 32 by this preventing a fluid flow through the at least one injection nozzle 34. The injection nozzle 34 may be, for example, an injection hole. Adjacent to the seat plate 32 a lower guide 35 is provided which is adapted to guide the valve needle 20 near the injection nozzle 34.

The valve assembly 11 is provided with an actuator unit 36 that may be an electro-magnetic actuator. The electro-magnetic actuator unit 36 comprises a coil 38, which may be arranged inside the housing 16 and overmolded. Furthermore, the electro-magnetic actuator unit 36 comprises the armature 22. The valve body 14, the housing 16, the inlet tube 12 and the armature 22 are forming an electromagnetic circuit.

A fluid outlet portion 40 is a part of the cavity 18 near the seat plate 32. The fluid outlet portion 40 communicates with a fluid inlet portion 42 which is provided in the valve body 14.

Inside the valve body 14 a step 44 is arranged in the valve body 14.

In the recess 28 of the armature 22 a spring element 46 is arranged axially between the ring element 23 and the protrusion 29 of the armature 22. The spring element 46 enables a transmission of forces between the protrusion 29 of the armature 22 and the ring element 23. The spring element 46 may have a high stiffness. This enables an exact transmission of the movement of the armature 22 to the valve needle 20 with a small delay of the movement of the valve needle 20. The dampening effect of the spring element 46 enables that the wearing effects on the armature 22 and/or on the valve needle 20 may be kept small during the opening or closing process of the valve needle 20.

An armature support spring 48 is arranged in the cavity 18 axially between the step 44 of the valve body 14 and the armature 22. The armature support spring 48 may be a coil spring. The armature support spring 48 is supported by the step 44 in the valve body 14. The armature support spring 48 may form a soft support element for the armature 22.

In the following, the function of the injection valve 10 is described in detail:

The fluid is led through the filter element 30 in the recess 26 to the fluid inlet portion 42. Subsequently, the fluid is led towards the fluid outlet portion 40.

The valve needle 20 prevents a fluid flow through the fluid outlet portion 40 in the valve body 14 in a closing position of the valve needle 20. Outside of the closing position of the valve needle 20, the valve needle 20 enables the fluid flow through the fluid outlet portion 40.

In the case when the electro-magnetic actuator unit 36 with the coil 38 gets energized the actuator unit 36 may affect an electro-magnetic force on the armature 22. The armature 22 is attracted by the electro-magnetic actuator unit 36 with the coil 38 and moves in axial direction away from the fluid outlet portion 40. The armature 22 takes the valve needle 20 with it via the spring element 46. Consequently, the valve needle 20 moves in axial direction out of the closing position. Outside of the closing position of the valve needle 20 the gap between the valve body 14 and the valve needle 20 at the axial end of the injection valve 10 facing away from of the actuator unit 36 forms a fluid path and fluid can pass through the injection nozzle 34.

In the case when the actuator unit 36 is de-energized the calibration spring 24 can force the valve needle 20 to move in axial direction in its closing position. It is depending on the force balance between the force on the valve needle 20 caused by the actuator unit 36 with the coil 38 and the force on the valve needle 20 caused by the calibration spring 24 whether the valve needle 20 is in its closing position or not.

Due to the spring element 46 a reliable transmission of the movement of the armature 22 to the valve needle 20 can be obtained. The high stiffness of the spring element 46 makes it possible that only a small delay of the movement of the valve needle 20 relative to the armature 22 may be obtained. The dynamic behavior of the valve needle 20 is dampened compared to the dynamic behavior of a valve needle 20 which is coupled to the armature 22 in a direct manner without the spring element 46 in-between. Therefore, the wearing effects on the armature 22 and/or the valve needle 20 in the contact area between the valve needle 20 and/or the armature 22 may be kept small during the opening or closing of the valve needle 20. Consequently, a good long term contact between the valve needle 20 and the armature 22 may be obtained. In the long term a static flow drift caused by the wearing effects may be kept small and a reliable transmission of the energy from the armature 22 to the valve needle 20 may be obtained.

What is claimed is:

1. A valve assembly for an injection valve, comprising:

a valve body including a central longitudinal axis and a cavity having a fluid inlet portion and a fluid outlet portion, a valve needle axially movable in the cavity, the valve needle having top and bottom portions, the bottom portion preventing a fluid flow through the fluid outlet portion in a closing position by resting on a seat preventing fluid flow through an injection nozzle and releasing the fluid flow through the fluid outlet portion to exit the injector body through the injection nozzle in further positions upon movement away from the seat, the valve needle comprising a ring element extending radially and being arranged at the top portion of the valve needle, an electro-magnetic actuator unit configured to actuate the valve needle, the electro-magnetic actuator unit comprising an armature axially movable in the cavity, the armature comprising a recess in which at least a portion of the ring element of the valve needle is located, and the armature further comprising a protrusion extending radially into the recess, a spring element arranged in the recess axially between and contacting the ring element of the valve needle and the protrusion of the armature, and an armature support spring arranged relative to the spring element and the armature such that an axial movement of the armature in the cavity increases a compressive force on one of the armature support spring and spring element, while decreasing a compressive force on the other one of the armature support spring and spring element.

2. The valve assembly of claim 1, wherein the spring element is a coil spring.

3. The valve assembly of claim 1, wherein the armature support spring is arranged in the cavity axially between a step of the valve body and the armature.

4. The valve assembly of claim 1, wherein the armature support spring is a coil spring.

5. An injection valve comprising:

a valve assembly comprising:

a valve body including a central longitudinal axis and a cavity having a fluid inlet portion and a fluid outlet portion, a valve needle axially movable in the cavity, the valve needle having top and bottom portions, the bottom portion preventing a fluid flow through the fluid outlet portion in a closing position by resting on a seat preventing fluid flow through an injection nozzle and releasing the fluid flow through the fluid outlet portion to exit the injector body through the injection nozzle in further positions upon movement away from the seat, the valve needle comprising a ring element extending radially and being arranged at the top portion of the valve needle, an electro-magnetic actuator unit configured to actuate the valve needle, the electro-magnetic actuator unit comprising an armature axially movable in the cavity, the armature comprising a recess in which at least a portion of the ring element of the valve needle is located, and the armature further comprising a protrusion extending radially into the recess, a spring element arranged in the recess axially between and contacting the ring element of the valve needle and the protrusion of the armature, and an armature support spring arranged relative to the spring element and the armature such that an axial movement of the armature in the cavity increases a compressive force on one of the armature support spring and spring element, while decreasing a compressive force on the other one of the armature support spring and spring element.

6. The injection valve of claim 5, wherein the spring element is a coil spring.

7. The injection valve of claim 5, wherein the armature support spring is arranged in the cavity axially between a step of the valve body and the armature.

8. The injection valve of claim 5, wherein the armature support spring is a coil spring.

9. A valve assembly for an injection valve, comprising:

a valve body including a central longitudinal axis and a cavity having a fluid inlet portion and a fluid outlet portion, a valve needle axially movable in the cavity, the valve needle having top and bottom portions, the bottom portion preventing a fluid flow through the fluid outlet portion in a closing position by resting on a seat preventing fluid flow through an injection nozzle and releasing the fluid flow through the fluid outlet portion to exit the injector body through the injection nozzle in further positions upon movement away from the seat, the valve needle comprising a ring element extending radially and being arranged at the top portion of the valve needle, a calibration spring mechanically coupled to the ring element of the valve needle, the calibration spring exerting a force on the valve needle toward the injection nozzle of the injection valve, an electro-magnetic actuator unit configured to actuate the valve needle, the electro-magnetic actuator unit comprising an armature axially movable in the cavity, the armature comprising a recess in which at least a portion of the ring element of the valve needle is located, and the armature further comprising a protrusion extending radially into the recess, and a spring element and arranged in the recess axially between and contacting the ring element of the valve needle and the protrusion of the armature, the spring element configured to delay a movement of the valve needle relative to the armature, and an armature support spring arranged in the cavity axially between a step of the valve body and the armature, the armature support spring being supported by the step.

10. The valve assembly of claim 9, wherein the ring element is in contact with an inner surface of the armature, which interaction guides the valve needle axially in the recess of the armature.

11. The injection valve of claim 9, wherein the spring element is a coil spring and encircles a portion of the valve needle.

12. The injection valve of claim 5, wherein the spring element is a coil spring and encircles a portion of the valve needle.

13. The injection valve of claim 1, wherein the spring element is a coil spring and encircles a portion of the valve needle.

* * * * *